US010513109B2

(12) United States Patent
Wang et al.

(10) Patent No.: US 10,513,109 B2
(45) Date of Patent: Dec. 24, 2019

(54) GRAVURE OFFSET PRINTING APPARATUS

(71) Applicant: INDUSTRIAL TECHNOLOGY RESEARCH INSTITUTE, Hsin-Chu (TW)

(72) Inventors: Kai-Jiun Wang, Changhua County (TW); Chih-Ming Chen, Taichung (TW); Yu-Ming Wang, Hsinchu (TW); Yi-Wei Lin, Taichung (TW)

(73) Assignee: INDUSTRIAL TECHNOLOGY RESEARCH INSTITUTE, Hsin-Chu (TW)

( * ) Notice: Subject to any disclaimer, the term of this patent is extended or adjusted under 35 U.S.C. 154(b) by 223 days.

(21) Appl. No.: 15/856,760

(22) Filed: Dec. 28, 2017

(65) Prior Publication Data

US 2019/0152214 A1 May 23, 2019

(30) Foreign Application Priority Data

Nov. 17, 2017 (TW) ..... 106139975 A

(51) Int. Cl.
*B41F 9/06* (2006.01)
*B41C 1/00* (2006.01)
(Continued)

(52) U.S. Cl.
CPC ..... *B41F 9/063* (2013.01); *B41C 1/003* (2013.01); *B41F 9/009* (2013.01); *B41F 13/193* (2013.01); *B41F 30/04* (2013.01)

(58) Field of Classification Search
CPC ..... B41F 9/063; B41F 9/009; B41F 13/193; B41F 30/04; B41C 1/003
See application file for complete search history.

(56) References Cited

U.S. PATENT DOCUMENTS 4,005,654 A 2/1977 Gundlach
6,276,266 B1 * 8/2001 Dietz ..... B41F 17/001 101/41
(Continued)

FOREIGN PATENT DOCUMENTS

CN 1323697 A 11/2001
CN 2936734 Y 8/2007
(Continued)

OTHER PUBLICATIONS

Taiwan Patent Office, "Office Action", dated Oct. 4, 2018.
(Continued)

*Primary Examiner* — David H Banh
(74) *Attorney, Agent, or Firm* — Locke Lord LLP; Tim Tingkang Xia, Esq.

(57) ABSTRACT

A gravure offset printing apparatus includes two clamps, a printing roller and a driving device. The two clamps are applicable to clamp individually two opposing ends of a blanket. The printing roller having an axial direction parallel to a first direction is disposed between the two clamps. The blanket wraps part of a radial periphery of the printing roller. The driving device is to drive the two clamps to undergo reverse motions so as to displace the blanket, and the blanket further rotates the printing roller. A gravure module, disposed on a platform of the gravure offset printing apparatus, has a groove for containing an offset ink. While the two clamps pull the blanket to undergo the reverse motions, a surface of the blanket contacts the gravure module so as to adhere the offset ink on the surface of the blanket.

10 Claims, 8 Drawing Sheets

(51) Int. Cl.

| | |
|---|---|
| ***B41F 30/04*** | (2006.01) |
| ***B41F 9/00*** | (2006.01) |
| ***B41F 13/193*** | (2006.01) |

(56) References Cited

U.S. PATENT DOCUMENTS

| | | | | |
|---|---|---|---|---|
| 8,039,040 | B2 | 10/2011 | Takeda et al. | |
| 8,365,663 | B2 * | 2/2013 | Kim | B41F 9/01 101/154 |
| 9,468,095 | B1 | 10/2016 | Wang et al. | |
| 9,713,268 | B2 * | 7/2017 | Hirano | H05K 3/1275 |
| 2004/0123753 | A1 * | 7/2004 | Yoo | B41M 1/10 101/158 |
| 2008/0184904 | A1 * | 8/2008 | Yoo | B41F 13/193 101/450.1 |
| 2010/0147168 | A1 * | 6/2010 | Puschel | B41F 13/193 101/217 |
| 2015/0217560 | A1 * | 8/2015 | Sakamoto | B41N 10/02 101/217 |
| 2015/0352829 | A1 * | 12/2015 | Sente | B41M 1/10 101/153 |

FOREIGN PATENT DOCUMENTS

| | | | |
|---|---|---|---|
| CN | 201423794 | Y | 3/2010 |
| CN | 102858541 | A | 1/2013 |
| CN | 104507685 | A | 4/2015 |
| CN | 105034560 | A | 11/2015 |
| JP | 2013129098 | A | 7/2013 |
| TW | 201302485 | A | 1/2013 |
| TW | I459876 | B | 11/2014 |
| TW | I584708 | B | 5/2017 |

OTHER PUBLICATIONS

Seunghwan Kim et al., Effect of printing parameters on gravure patterning with conductive silver ink,Journal of Micromechanics and Microengineering, 2015, 25.

K. Kordás et al., Laser soldering of flip-chips, Optics and Lasers in Engineering, 2006, 44, 112-121.

Hyun Wook Kang et al., Liquid transfer between two separating plates for micro-gravure-offset printing, Journal of Micromechanics and Microengineering, 2009, 19.

Fatemeh Ghadiri et al., Non-Newtonian ink transfer in gravure-offset printing, International Journal of Heat and Fluid Flow, 2011, 32, pp. 308-317.

Mark Pudas et al., Printing parameters and ink components affecting ultra-fine-line gravure-offset printing for electronics applications, Journal of the European Ceramic Society, 2004, 24, pp. 2943-2950.

Dewan Hasan Ahmed et al., Simulation of non-Newtonian ink transfer between two separating plates for gravureoffset printing, International Journal of Heat and Fluid Flow, 2011, 32, pp. 298-307.

Wei-Xi Huang et al., Simulation of liquid transfer between separating walls for modeling micro-gravureoffset printing, International Journal of Heat and Fluid Flow, 2008, 29, pp. 1436-1446.

* cited by examiner

GRAVURE OFFSET PRINTING APPARATUS

CROSS REFERENCE TO RELATED APPLICATION

This application claims the benefits of Taiwan application Serial No. 106139975, filed Nov. 17, 2017, the disclosures of which are incorporated by references herein in its entirety.

TECHNICAL FIELD

The present disclosure relates in general to an offset printing apparatus, and more particularly to a gravure offset printing apparatus.

BACKGROUND

Generally, the gravure offset printing needs a blanket to carry out fine-lining printing. The broader the effective printing area is, the larger the printing roller for the is blanket should be. For a line width below 3 μm, broad-area printing become more severe. One of the reasons is that, for a curvature limitation upon the blanket, while in processing broad-area offset printing, a contact area between the printing roller and the gravure module becomes almost a flat surface due to an excessive diameter of the printing roller. Thereupon, a corresponding dipping depth would be too small to pick up sufficient ink, and thus quality and yield of the offset printing would be significantly influenced.

Hence, large-scale metallic network touch-panel components with line widths lower than 3 μm are almost manufactured by yellow-light etching processes. Practically, a product with 30+ inches area manufactured by the gravure offset printing is never seen.

Accordingly, an improvement on the gravure offset printing for overcoming the aforesaid ink problem of a large printing roller in producing broad-area and fine-lining products is definitely urgent to the skilled person in the art.

SUMMARY

In one embodiment of this disclosure, a gravure offset printing apparatus includes two clamps, a printing roller, a driving device and a gravure module.

The two clamps are applicable to clamp individually two opposing ends of a blanket.

The printing roller is disposed between the two clamps in a sense of blanket arrangement, and has an axial direction parallel to a first direction. The blanket is curved tightly by a portion of a periphery of the printing roller.

The driving device is to drive the two clamps, and thus the blanket clamped therebetween, to undergo reverse motions. Thus, motions of the blanket rotate the printing roller.

The gravure module, located on a platform of the gravure offset printing apparatus, has a groove for containing an offset ink. While the two clamps pull the blanket to undergo the reverse motions, a surface of the blanket contacts the gravure module so as to adhere the offset ink on the surface of the blanket.

Further scope of applicability of the present application will become more apparent from the detailed description given hereinafter. However, it should be understood that the detailed description and specific examples, while indicating exemplary embodiments of the disclosure, are given by way of illustration only, since various changes and modifications within the spirit and scope of the disclosure will become apparent to those skilled in the art from this detailed description.

BRIEF DESCRIPTION OF THE DRAWINGS

The present disclosure will become more fully understood from the detailed description given herein below and the accompanying drawings which are given by way of illustration only, and thus are not limitative of the present disclosure and wherein.

DETAILED DESCRIPTION

Figure 1:
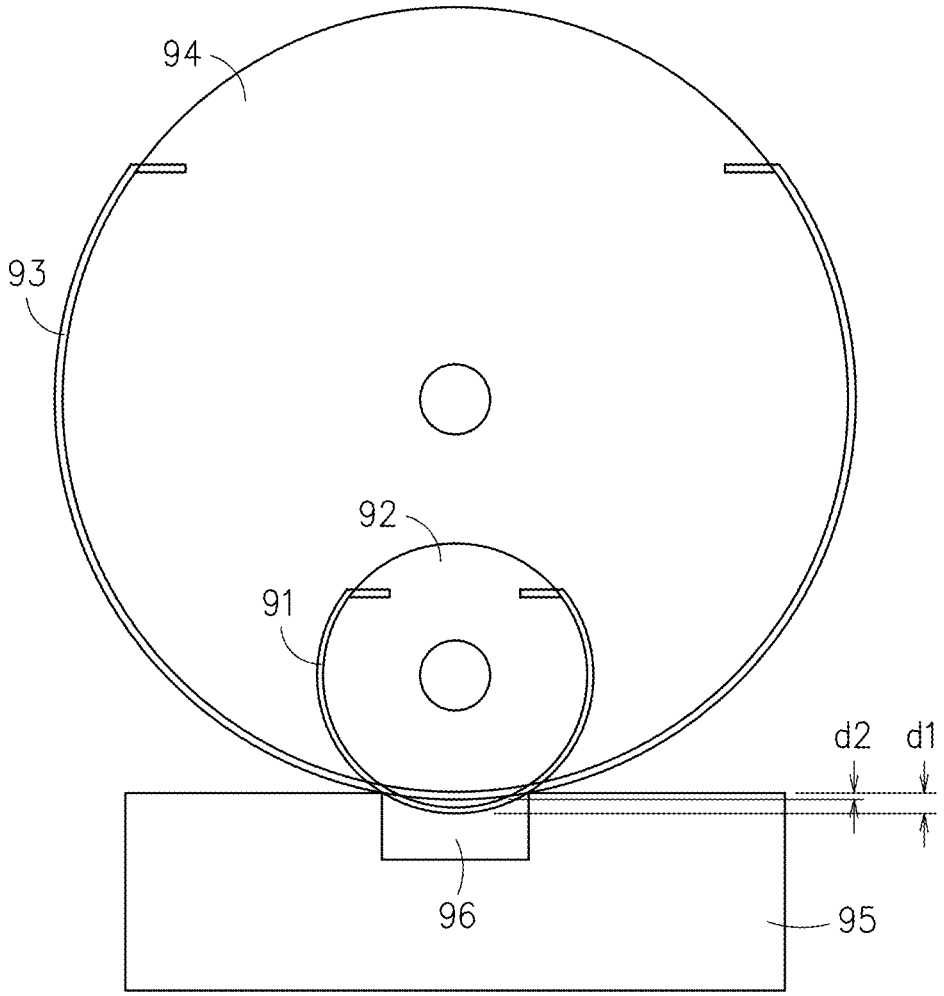
FIG. 1 shows schematically two different dipping depths made by corresponding printing rollers with different diameters.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Referring now to FIG. 1, a small blanket 91 wraps a small printing roller 92, while another large blanket 93 wraps a large printing roller 94 having a diameter larger than another diameter of the small printing roller 92. With respect to a gravure module 95 having a groove 96 filled with an offset ink, a dipping depth d1 of the small blanket 91 is larger than another dipping depth d2 of the large blanket 93. Hence, it is the point of this disclosure to utilize that the smaller roller is accompanied by a larger dipping depth d1, so that a larger area can be valid for the gravure offset printing.

Figure 2:
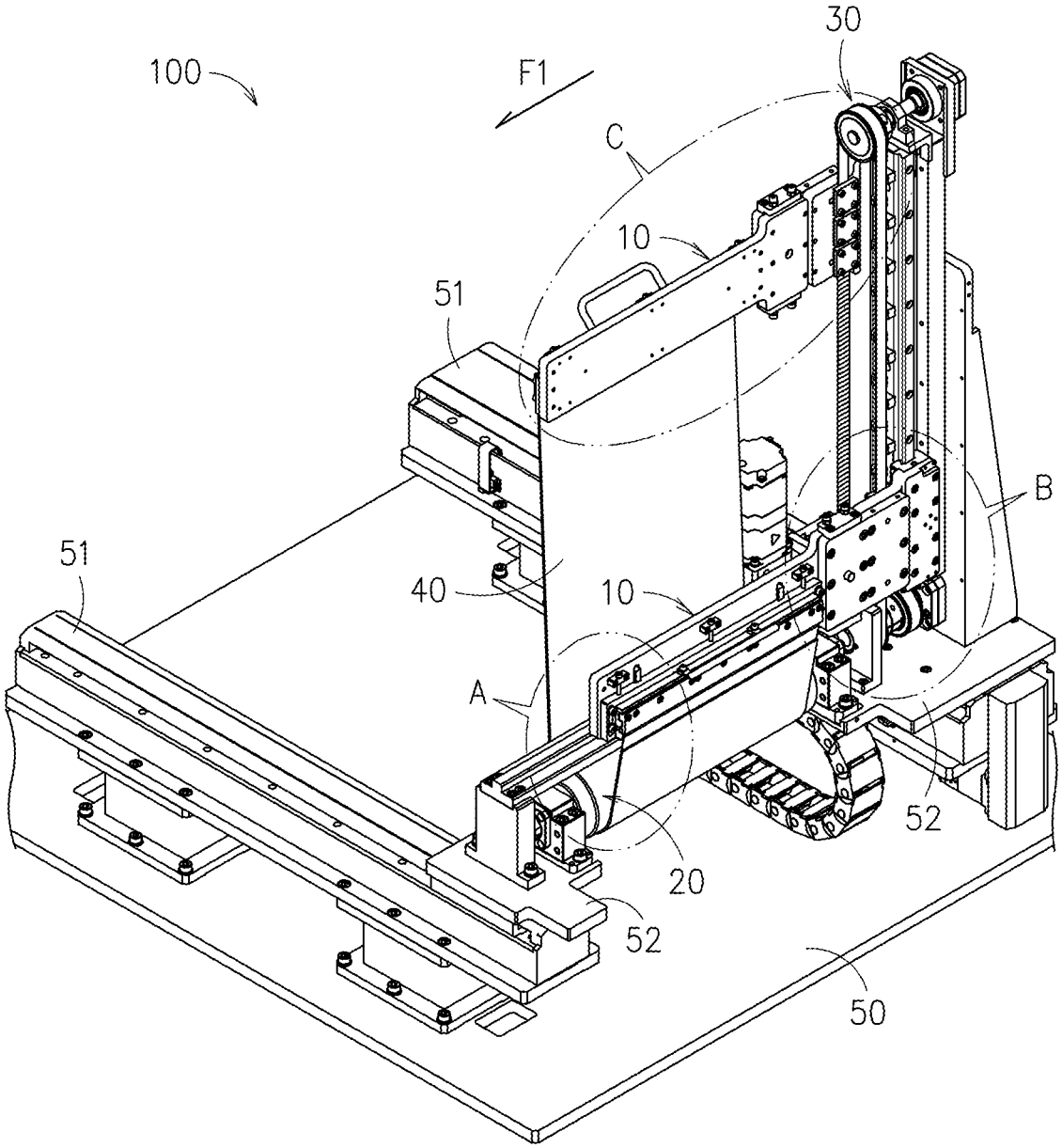
FIG. 2 is a schematic perspective view of an embodiment of the gravure offset printing apparatus in accordance with this disclosure.

Referring to the embodiment shown in FIG. 2, this gravure offset printing apparatus 100 includes two clamps 10, a printing roller 20 and a driving device 30.

The two clamps 10 is applicable to clamp individually two opposing ends of a blanket 40. The printing roller 20 is disposed between the two clamps 10 in a sense of blanket arrangement. The blanket 40 wraps, i.e. is curved tightly by, a portion of a periphery of the printing roller 20. The printing roller 20 has an axial direction parallel to a first direction F1.

Figure 3:
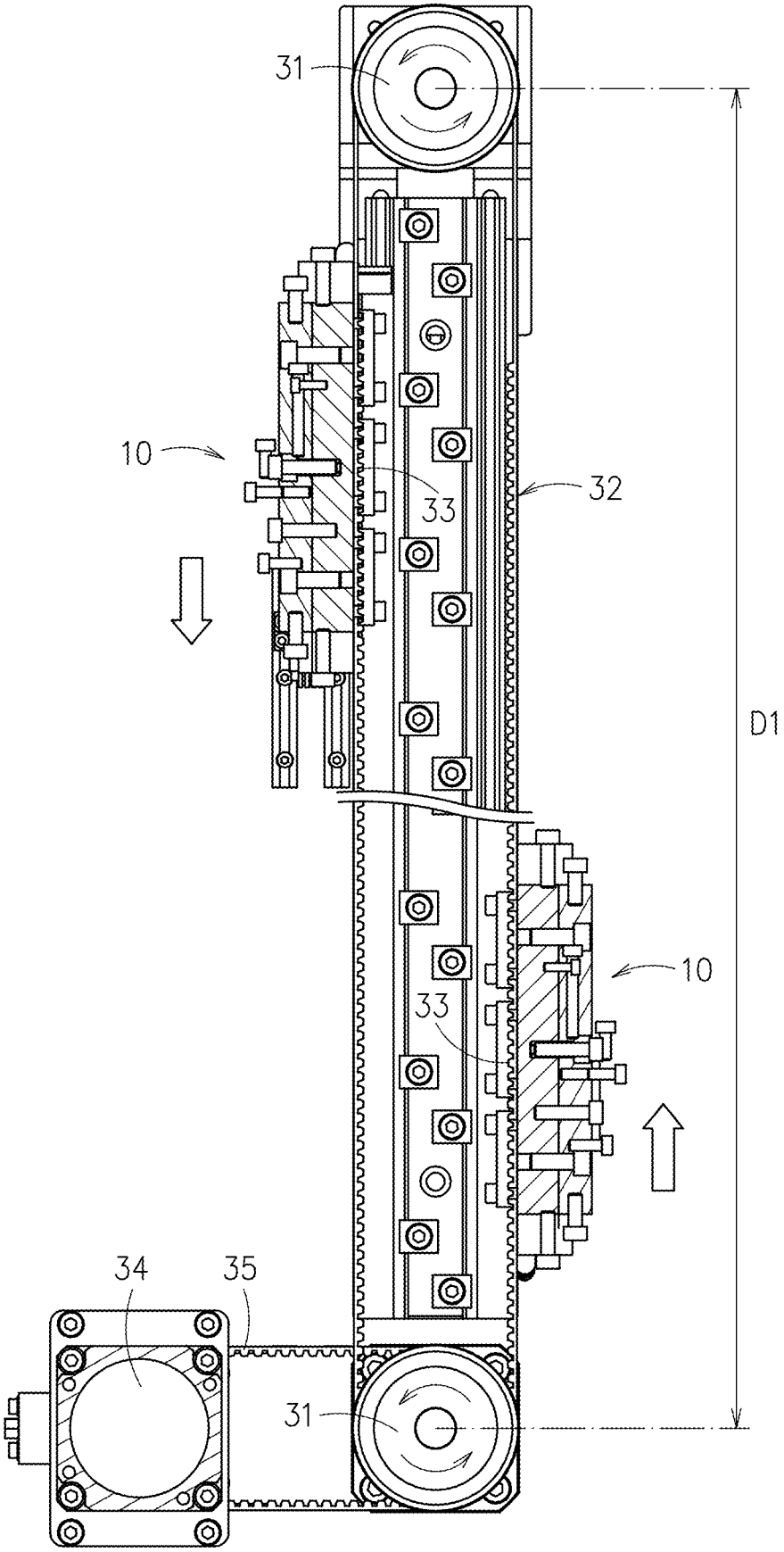
FIG. 3 is a schematic cross-sectional view of the driving device of FIG. 2.

Referring now to FIG. 2 and FIG. 3, the driving device 30 includes two rollers 31 and a belt 32. Individual axes of the two rollers 31 are parallel to the first direction F1, and the two parallel axes of the two rollers 31 are spaced by a distance D1. The belt 32 surrounds part of radial peripheries of the two rollers 31, so that two loading portions 33, parallel to each other largely, can be formed between the two rollers 31. The two clamps 10 are individually disposed at the corresponding loading portions 33. It shall be understood that positions at the respective loading portions 33 for the individual clamps 10 to be located are determined by the dimensions of the blanket 40. When the rollers 31 rotate, the belt 32 is moved to drive the two clamps 10 to undergo reverse motions and pull the blanket 40 to move. Also, the blanket 40 can drive the printing roller 20 to rotate synchronously. For example, when the motor 34 drives a power belt 35 connecting and thus driving one of the two rollers 31, the belt 32 connected with the same roller 31 is also moved. The motions of the power belt 35 and the belt 32 would drive the near roller 31 on the platform 50 to rotate counterclockwisely, for example; while the distant roller 31 on the platform 50 is also driven to rotate counterclockwisely. At this time, the loading portions 33 fixed on the belt 32 would displace synchronously, and thus the clamps 10 on the respective loading portions 33 would displace synchronously. Then, the clamp 10 at the right side of FIG. 3 would be ascended, while the clamp 10 at the left side of FIG. 3 would be descended simultaneously. Thus, the blanket 40 clamped by these two clamps 10 would be displaced synchronously so as further to drive the printing roller 20 to rotate.

It shall be explained that, in this embodiment, the belt-driving means is applied. However, in some other embodiments, other types of driving means or the driving device can be also applied.

Referring now to FIG. 2, FIG. 4, FIG. 5 and FIG. 6, the clamp 10 includes a clamping arm 11, a position-clamping unit 12 and a blanket-clamping unit 13. The clamping arm 11 extends in the first direction F1 by a length. The clamping arm 11 has a fixation end 111 extended in a longitudinal direction of the clamping arm 11. The position-clamping unit 12 and the fixation end 111 are detachably connected to the driving device 30 by having the clamping arm 11 parallel to the first direction F1 and to extend out of the driving device 30. The blanket-clamping unit 13 and the clamping arm 11 are detachably connected, and the blanket 40 is clamped between the blanket-clamping unit 13 and the clamping arm 11.

Figure 5:
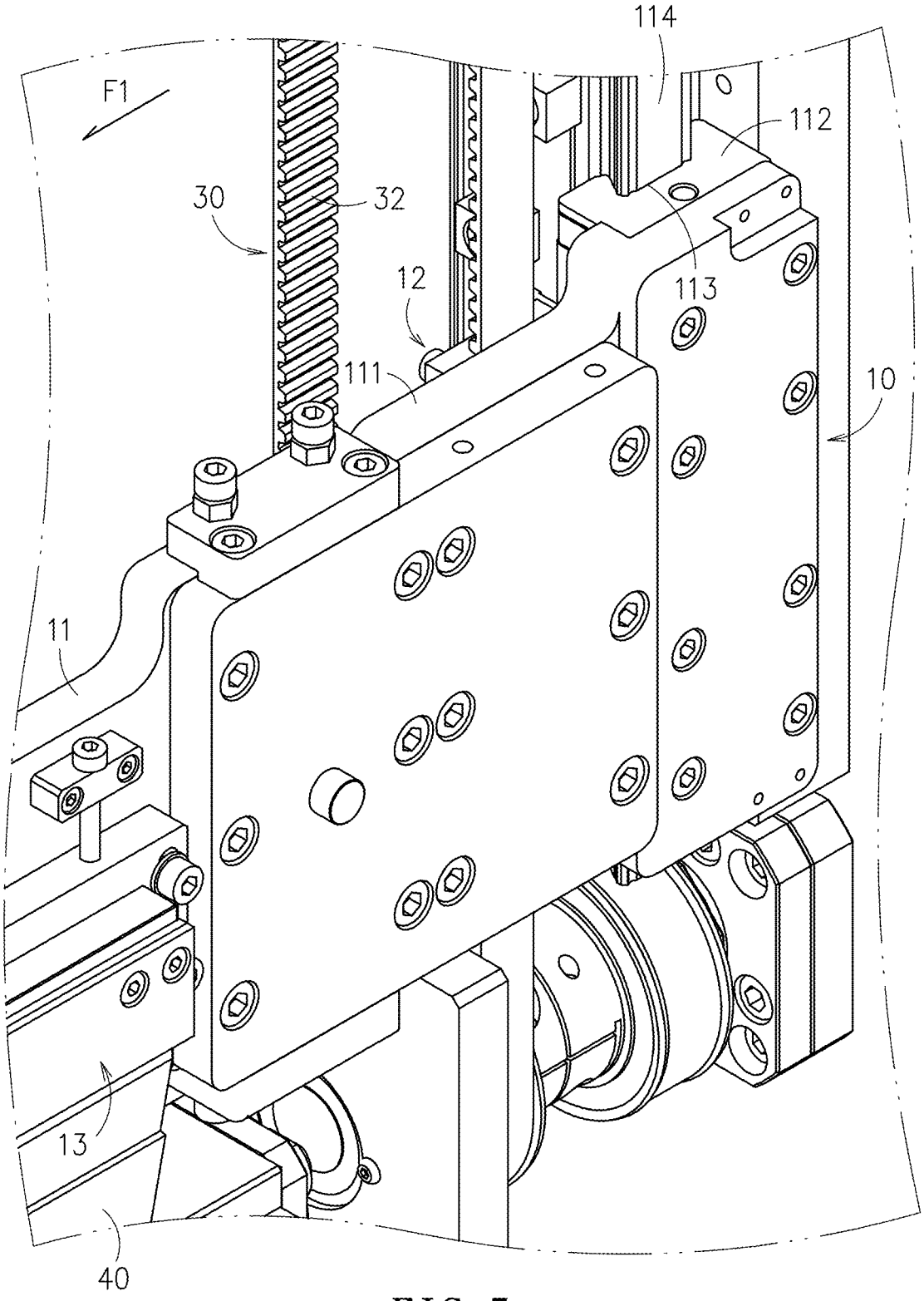
FIG. 5 is a schematic enlarged view of area B of FIG. 2.
Figure 6:
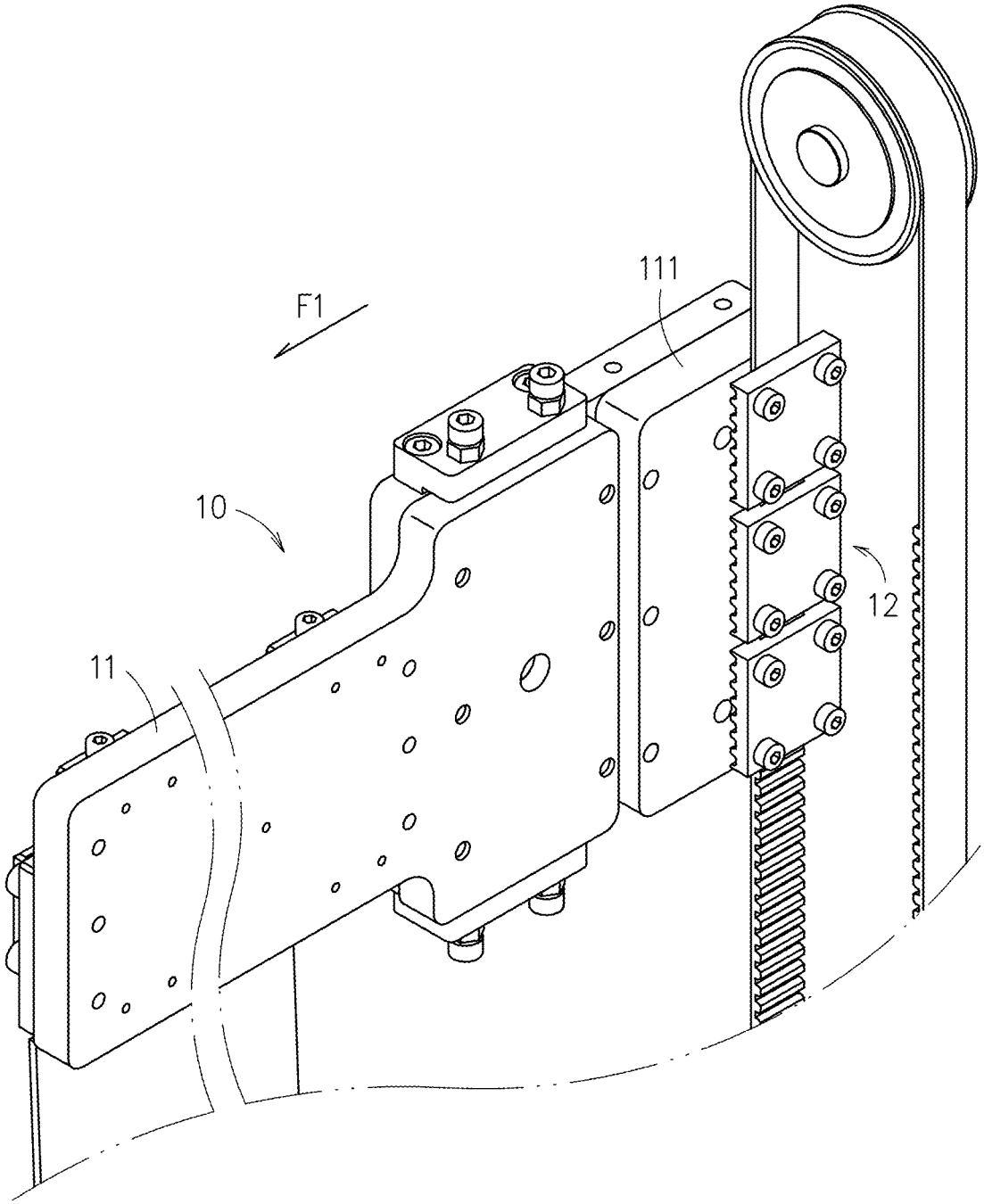
FIG. 6 is a schematic enlarged view of area C of FIG. 2.

Referring to FIG. 5, an extension block 112, disposed on the fixation end 111, has a sliding groove 113 and a sliding carrier 114, pairing to each other. The sliding carrier 114 has a longitudinal extending direction perpendicular to the first direction F1. By providing the extension block 112 and the sliding carrier 114, motion stability of the driving of the belt 31 upon the clamp 10 can be enhanced.

Figure 4:
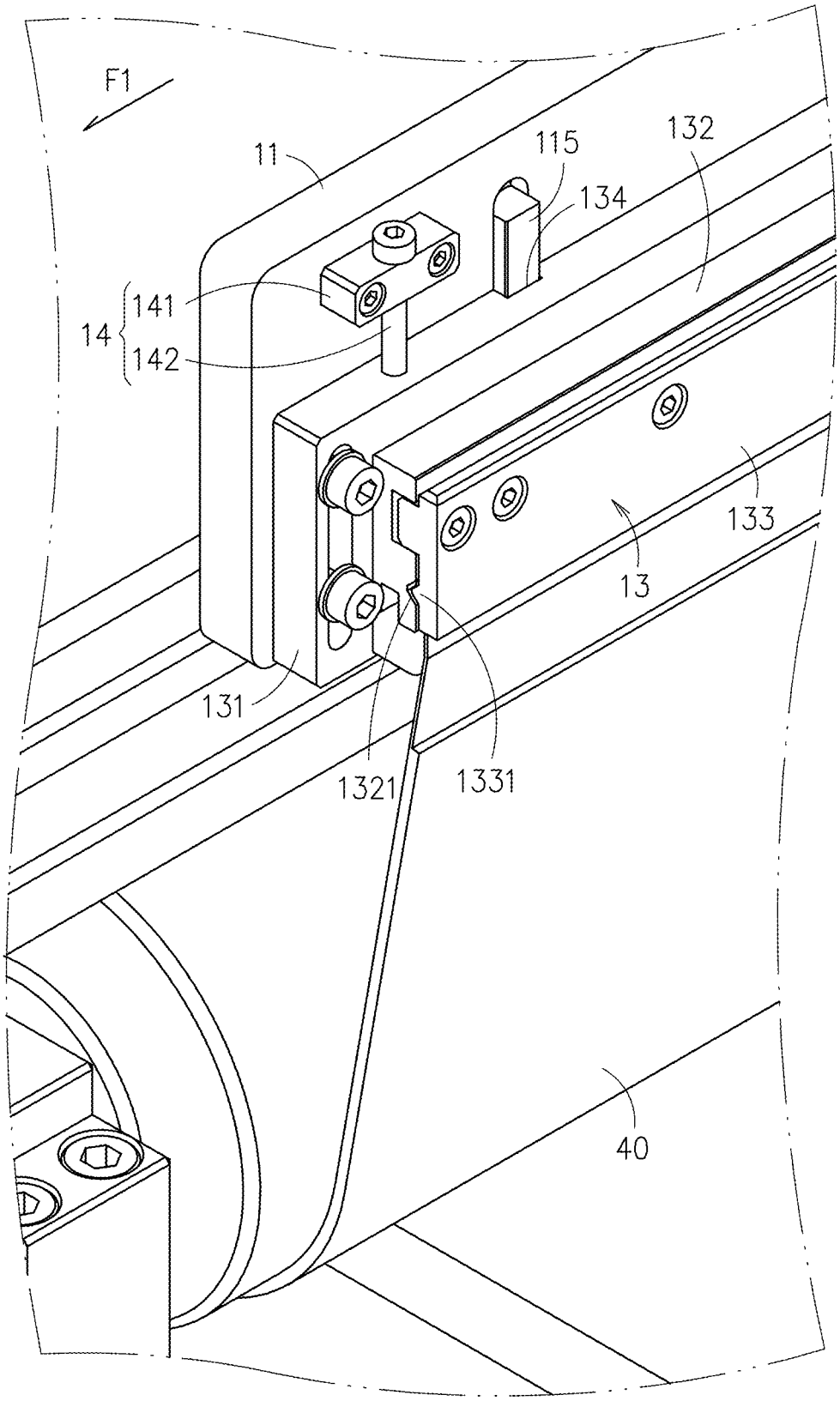
FIG. 4 is a schematic enlarged view of area A of FIG. 2.

Referring now to FIG. 2 and FIG. 4, the blanket-clamping unit 13 includes a fine-tuning block 131, and two clamping blocks 132, 133. The fine-tuning block 131 has a length extended in the first direction F1, and is disposed displaceably on the clamping arm 11. In details, the fine-tuning block 131 for adjusting positions of the blanket 40 can be displaced with respect to the clamping arm 11, in which a moving direction of the fine-tuning block 131 is perpendicular to the first direction F1 so as able to fine-tune the blanket 40. The two clamping blocks 132, 133 are disposed on the fine-tuning block 131, and each of the two clamping blocks 132, 133 has a length extending in the first direction F1. Since the two clamping blocks 132, 133 are used to clamp and fix the blanket 40 in between thereof, a clamping groove 1321 and a clamping flange 1322 forming an engagement pair with the clamping groove 1321 are disposed on the two clamping blocks 132, 133, respectively. Both the clamping groove 1321 and the clamping flange 1331 are extended in the first direction F1. In this embodiment, the engagement between the clamping groove 1321 and the clamping flange 1322 is a V-shape match so as to strengthen the clamping upon the blanket 40. However, in some other embodiments, the match for engaging the clamping groove 1321 and the clamping flange 1322 can be any relevant pair, not limited to the aforesaid V-shape match.

Referring now to FIG. 2 and FIG. 4, the blanket-clamping unit 13 has a plurality of tension-adjusting units 14, and each of the tension-adjusting units 14 includes a unit body 141 and an adjustment bolt 142. The unit body 141 is disposed on the clamping arm 11, and the adjustment bolt 142 penetrates through the unit body 141 and then has one end thereof to contact at a top of the blanket-clamping unit 13. By adjusting the depth, namely by adjusting a depth of the adjustment bolt 142 into the blanket-clamping unit 13, the tension of the blanket 40 can be adjusted. In this disclosure, the number of the tension-adjusting units 14 is not limited to three as shown in FIG. 3, but is determined per requirements.

Referring now to FIG. 2 and FIG. 4, two pairs of the guide protrusion 115 and the guide groove 134 are provided between the clamping arm 11 and the blanket-clamping unit 13, as guiding upon when the adjustment bolt 142 adjusts the screw-in depth. Both the guide protrusion 115 and the guide groove 134 are extended in a direction perpendicular to the first direction F1.

It shall be explained that the structures of the two clamps 10 though the same in the foregoing embodiment, but may be different in accordance with this disclosure.

Figure 7:
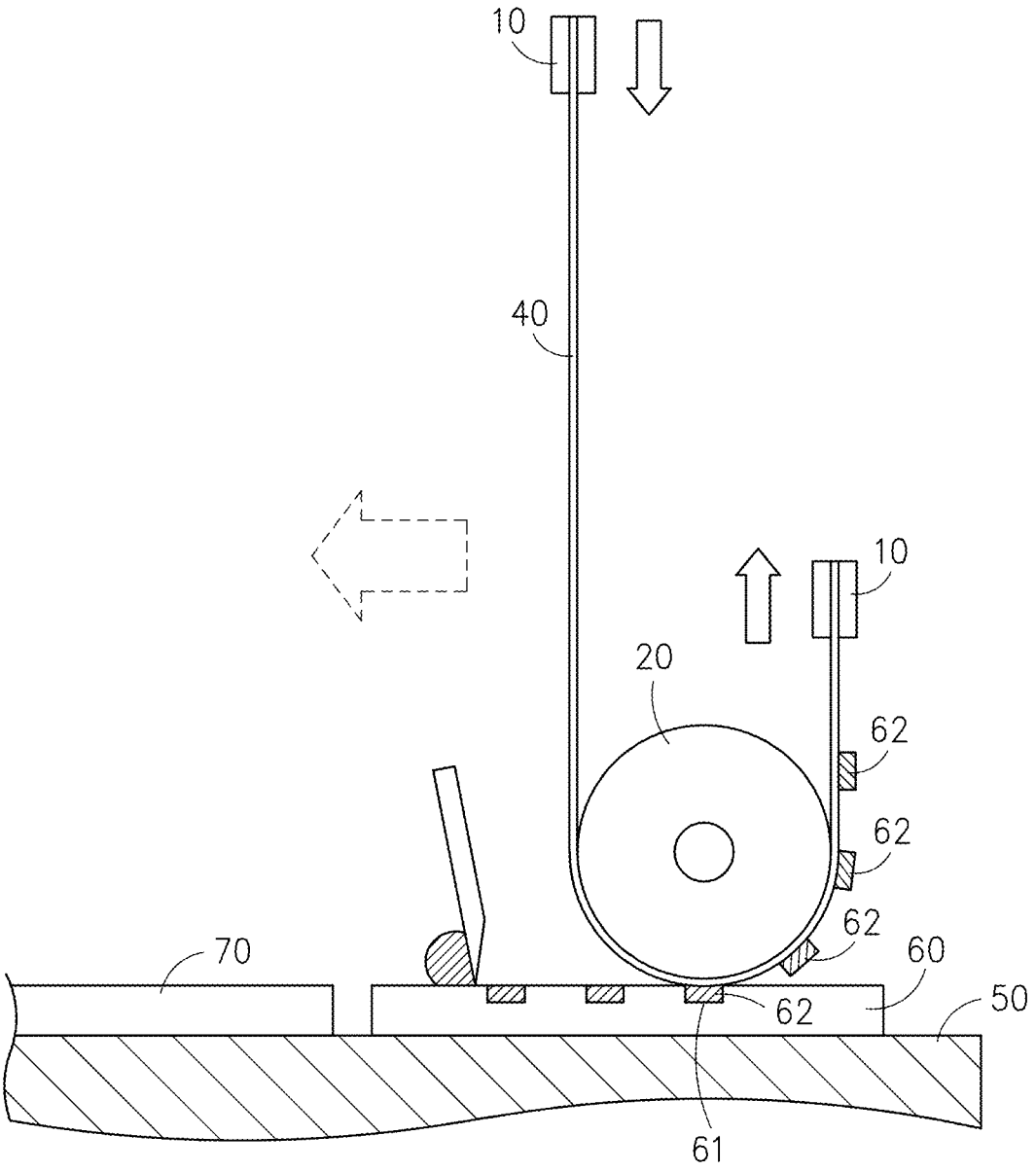
FIG. 7 demonstrates schematically a process of offset printing in accordance with this disclosure.

Referring to FIG. 2 and FIG. 7, the embodiment further includes a platform 50. A pair of rails 51 and a pair of sliding carriers 52 riding on the pair of rails 51 are disposed on the platform 50. The pair of sliding carriers 52 is used to load the two clamps 10, the blanket 40, the printing roller 20 and the driving device 30 to move thereon along the rails 51. Also, on the platform 50, a gravure module 60 has at least one groove 61 for containing an offset ink 62. A substrate 70 is disposed at a side of the platform 50 opposing to the side where the gravure module 60 is. While the two clamps 10 pull the blanket 40 to move, an outer surface of the blanket 40 contacts the offset ink 62 in the groove 61 of the gravure module 60, so that the offset ink 62 can adhere on the surface of the blanket 40. In addition, the blanket 40 can move toward the substrate 70 preferably at a constant speed via the rails 51 and sliding carriers 52. After the offset ink 62 completely adheres on the surface of the blanket 40, the rails 51 and the sliding carriers 52 then transport the blanket 40 adhered with sufficient offset ink 62 to a predetermined position above the substrate 70 for processing contact with the substrate 70. Then, the two clamps 10 move reversely to pull the blanket 40 in a reverse direction as well. Thus, the offset ink 62 on the blanket 40 can be transferred on a surface of the substrate 70.

Figure 8:
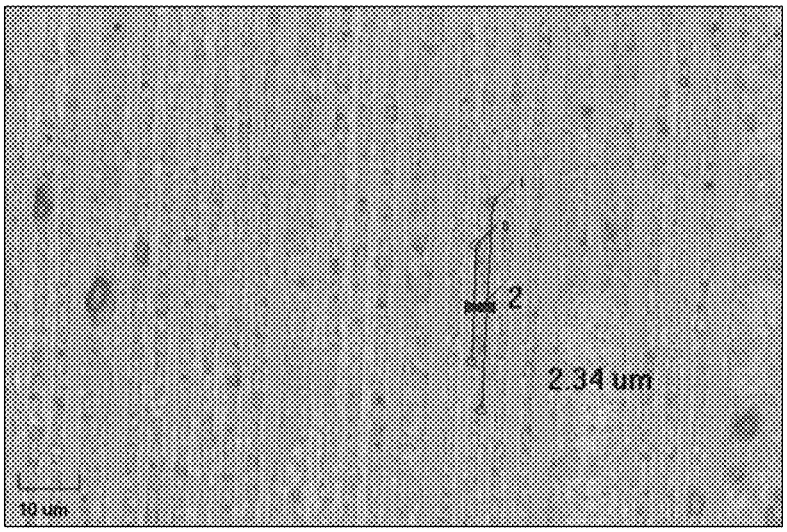
FIG. 8 (Prior art)
FIG. 8 is a schematic view showing an offset print from a large printing roller by a conventional offset printing machine.
Figure 9:
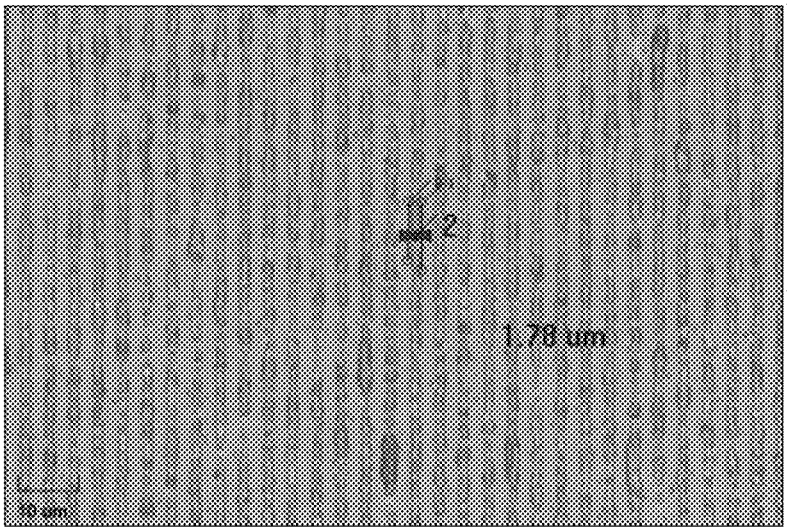
FIG. 9 is a schematic view showing another offset print from a smaller printing roller than that of FIG. 8 by the gravure offset printing machine in accordance with this disclosure.

Refer to FIG. 8 and FIG. 9; where FIG. 8 is a schematic view showing an offset print from a large printing roller by a conventional offset printing machine, and FIG. 9 is a schematic view showing another offset print from a smaller printing roller than that of FIG. 8 by the gravure offset printing machine in accordance with this disclosure. In both examples, the same gravure module with the groove having a width of 2 μm is applied. Also, these two examples of printing lines are performed with the same materials and under the same experimental parameters. The number "2" labeled in each of FIG. 8 and FIG. 9 stands for a standard line width, while the labels "2.34 μm" and "1.78 μm" stand for respective printing results. As shown in FIG. 8 (the prior art), the printing result shows non-uniform lines in different line widths and different densities, and also mixing of neighboring lines are found. On the other hand, in FIG. 9 where the gravure offset printing apparatus of this disclosure is applied to introduce a smaller printing roller for offset printing, it is found that the uniformity of FIG. 9 in line widths and densities is superior to that of FIG. 8. Empirically, the line-width quality provided by the gravure offset printing apparatus of this disclosure is much improved, to have a line width ranging from 50 nm~50 μm.

In summary, the gravure offset printing apparatus provided by this disclosure takes advantages of applying a small printing roller to improve the dipping depth of the blanket in the groove, and also integrates the belt transmission to fulfill a broad-area printing. Thereupon, the yield of the offset printing in fine line widths can be improved, and also the printing length won't be limited by the size of the printing roller. Thus, the aforesaid shortcomings of the conventional gravure offset printing apparatus in difficultly picking up sufficient ink by a large printing roller have been effectively resolved by the gravure offset printing apparatus of this disclosure. In addition, the gravure offset printing apparatus provided by this disclosure is structurally open, and thus would be assembled much easier.

With respect to the above description then, it is to be realized that the optimum dimensional relationships for the parts of the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present disclosure.

What is claimed is:

1. A gravure offset printing apparatus, comprising:

two clamps, applicable to clamp individually two opposing ends of a blanket;

a printing roller, disposed between the two clamps, the blanket wrapping part of a radial periphery of the printing roller, having an axial direction parallel to a first direction; and a driving device, being to drive the two clamps to undergo reverse motions so as to displace the blanket, the blanket further rotating the printing roller;

wherein a gravure module, disposed on a platform of the gravure offset printing apparatus, has a groove for containing an offset ink;

wherein, while the two clamps pull the blanket to undergo the reverse motions, a surface of the blanket contacts the gravure module so as to adhere the offset ink on the surface of the blanket.

2. The gravure offset printing apparatus of claim 1, wherein the driving device includes:

two rollers, having individual axes parallel to the first direction, the two axes of the two rollers being spaced by a distance; and a belt, surrounding part of radial peripheries of the two rollers, forming two loading portions largely parallel to each other between the two rollers, the two clamps being individually mounted to the two loading portions.

3. The gravure offset printing apparatus of claim 1, wherein each of the two clamps includes:

a clamping arm, having a length and a fixation end extending in the first direction;

a position-clamping unit, the position-clamping unit and the fixation end being detachably connected to the driving device by having the clamping arm parallel to the first direction and to extend out of the driving device; and a blanket-clamping unit, the blanket-clamping unit and the clamping arm being detachably connected, the blanket being clamped between the blanket-clamping unit and the clamping arm.

4. The gravure offset printing apparatus of claim 3, wherein the blanket-clamping unit includes:

a fine-tuning block, having a length extending in the first direction, located displaceably at the clamping arm; and two clamping blocks, having individual lengths parallel to each other and extending in the first direction, mounted to the fine-tuning block, being to clamp the blanket.

5. The gravure offset printing apparatus of claim 4, wherein a clamping groove and a clamping flange forming an engagement pair with the clamping groove are disposed on the two clamping blocks, respectively, and both the clamping groove and the clamping flange are extended in the first direction.

6. The gravure offset printing apparatus of claim 3, wherein the blanket-clamping unit has a plurality of tension-adjusting units, and each of the tension-adjusting units includes:

a unit body, mounted at the clamping arm; and an adjustment bolt, penetrating through the unit body, having one end thereof to contact at a top of the blanket-clamping unit; wherein, by adjusting a depth of the adjustment bolt in the blanket-clamping unit, a tension of the blanket is thus adjusted.

7. The gravure offset printing apparatus of claim 6, wherein at least one engaged pair of a guide protrusion and a guide groove are disposed between the clamping arm and the blanket-clamping unit as guiding upon when the adjustment bolt adjusts the depth.

8. The gravure offset printing apparatus of claim 7, wherein the guide protrusion and the guide groove have individual longitudinal extending directions, and both of longitudinal extending directions are extended by perpendicular to the first direction.

9. The gravure offset printing apparatus of claim 1, wherein a pair of rails and a pair of sliding carriers riding on the pair of rails are disposed on the platform, and the pair of sliding carriers loads the two clamps, the blanket, the printing roller and the driving device to move along the rails.

10. The gravure offset printing apparatus of claim 9, further comprising a substrate disposed at a side of the platform opposing to another side where the gravure module is; wherein, while the pair of rails and the pair of sliding carriers transport the blanket adhered with the offset ink to a predetermined position above the substrate, the offset ink adhering the blanket is then transferred to a surface of the substrate.

* * * * *